US007931442B1

(12) United States Patent
Liang

(10) Patent No.: US 7,931,442 B1
(45) Date of Patent: Apr. 26, 2011

(54) ROTOR BLADE ASSEMBLY WITH DE-COUPLED COMPOSITE PLATFORM

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 876 days.

(21) Appl. No.: 11/809,326

(22) Filed: May 31, 2007

(51) Int. Cl.
*F01D 5/30* (2006.01)

(52) U.S. Cl. ..... 416/193 A; 416/220 R

(58) Field of Classification Search ..... 416/190, 416/196 R, 221, 220 R, 193 A, 241 B
See application file for complete search history.

(56) References Cited

U.S. PATENT DOCUMENTS 3,008,689 A * 11/1961 Morely et al. ..... 416/221
3,294,364 A 12/1966 Stanley
4,175,912 A * 11/1979 Crane et al. ..... 416/193 A
4,655,687 A 4/1987 Atkinson
5,222,865 A 6/1993 Corsmeier
6,726,452 B2 4/2004 Strassberger et al.
6,832,896 B1 * 12/2004 Goga et al. ..... 416/191
7,300,253 B2 * 11/2007 Beeck et al. ..... 416/193 A
* cited by examiner

*Primary Examiner* — Edward Look
*Assistant Examiner* — Dwayne J White
(74) *Attorney, Agent, or Firm* — John Ryznic

(57) ABSTRACT

A rotor disk assembly with a platform spacer secured to the rotor disk and un-coupled from the rotor blades. Adjacent rotor blades are secured to the rotor disk slots by conventional means. The rotor disk includes a dovetail extending from the rim and positioned substantially midway between adjacent rotor blades. A platform spacer having a size and shape to occupy substantially the entire space formed between the adjacent rotor blades and the rotor disk rim is secured through a slot to the dovetail projecting from the rim. The platform spacer is a solid piece and forms the outer hot gas flow path between the blades. The platform spacer provides damping to the rotor blade assembly as well as eliminates hot gas flow migration below the platform. The platform space also un-couples the platform from the blades so that the load due to the platform is transmitted directly to the rotor disk and not through the blades, allowing for the blades to have improved LCF. Uncoupling the platform from the blade also eliminates the thermal mismatch between the platform and the blade which produces excessive levels of stress at this junction. With the un-coupled platform spacer of the present invention, the rotor blades can be formed from a single crystal material to allow for higher temperature limits and longer LCF of the assembly.

11 Claims, 3 Drawing Sheets

ROTOR BLADE ASSEMBLY WITH DE-COUPLED COMPOSITE PLATFORM

BACKGROUND OF THE INVENTION

1. Field of the Invention

The present invention relates generally to a gas turbine engine, and more specifically to a turbine rotor disk assembly with a de-coupled platform.

2. Description of the Related Art Including Information Disclosed Under 37 CFR 1.97 and 1.98

In a gas turbine engine, such as an aero or an industrial gas turbine engine, a compressor supplies a compressed air to a combustor, the combustor burns a fuel with the compressed air to produce a hot gas flow, and the hot gas flow is passed through a multiple staged turbine to extract mechanical power to drive the rotor shaft. In an aero engine, the rotor shaft is used to drive the compressor, while in an industrial gas turbine engine the rotor shaft drives the compressor and an external electric generator.

The industrial gas turbine engine is especially designed for the highest efficiency possible. Weight is not a major factor since the engine is secured in a stationary environment. The efficiency of a gas turbine engine can be increased by using a higher gas flow temperature passing into the turbine section. the gas flow temperature is limited to the material characteristics of the first stage turbine airfoils which include the stator vanes and the rotor blades.

To allow for a higher gas flow temperature in the first stage of the turbine section, improved cooling of the airfoils can be used. Turbine airfoils are designed with a complex arrangement of internal convection cooling passages and film cooling holes to maximize the airfoil cooling while minimizing the amount of pressurized cooling air used. Airfoil cooling circuits are customized in order to provide specific cooling amount over certain surfaces of the airfoils because not all of the surfaces are exposed to the same high gas flow temperatures.

In a rotor disk having a plurality of rotor blades extending from the disk and into the hot gas flow, each rotor blade is secured to the rotor disk through a slot, typically a fir tree shaped slot. In an industrial gas turbine engine, the size of the rotor blades is quite large. These large rotor blades also have a large mass. With a large mass in a rotating machine, the blades are exposed to high creep which can shorten the life of a rotor blade. In an industrial gas turbine engine, the engine runs for 24,000 to 48,000 hours before shutdown. Thus, the most efficient rotor blades are designed to have both light weight and resistance to high gas flow temperatures in order to provide for long life.

A prior art rotor blade includes an airfoil portion extending from a root portion with a platform formed at the lower airfoil portion to form an inner hot gas flow surface through the airfoil. The integral blade platform adds weight to the rotor blade. This extra weight on the rotor blade is carried by the blade root and the blade attachment slot in the rotor disk. Thus, the blade root must be designed to hold both the airfoil portion and the platform portion to the rotor disk.

A rotor blade made from a single crystal superalloy has a higher resistance to temperature than a non single crystal superalloy blade. However, forming a rotor blade with an integral platform from a single crystal material has major problems. One problem is that the platform extends substantially at a 90 degree angle from the single crystal direction of the rotor blade, which causes problems during casting. Many defective single crystal rotor blades are formed when the platform is formed integral to the blade.

Thus, it would be beneficial in the gas turbine engine to allow for a single crystal turbine blade to be used with a de-coupled platform for the purpose of allowing for the rotor blade to be made from a single crystal material to allow for higher gas flow temperatures. Also, it would be beneficial to form a rotor blade with a separate and de-coupled platform for the purpose of removing the loading due to the platform from the rotor blade root and slot attachment structure. In other words, the blade does not have to support the platform.

The U.S. Pat. No. 6,726,452 B2 issued to Strassberger et al on Apr. 27, 2004 and entitled TURBINE BLADE ARRANGEMENT discloses a turbine rotor blade assembly with adjacent rotor blades secured within the rotor disk slots and a platform un-coupled from the rotor blades and secured to the rotor disk by a holding device. The Strassberger invention un-couples the platform from the rotor blades and allows for a single crystal rotor blade, but has several problems in which the present invention solves. One problem with the Strassberger invention is that a large air gap is formed between the platform and the rotor disk that will allow for hot gas flow injection and require purge air to cool the space.

Also a problem in the prior art turbine rotor blades, the hot gas migration phenomenon on the airfoil pressure side is created by the combination of hot flow core gas axial velocity and static pressure gradient exerting on the surfaces of the airfoil pressure wall and the suction wall of an adjacent airfoil. Because of this hot gas flow, some of the hot core gas flow from the upper airfoil span is transferred toward a close proximity to the platform and thus creates a high heat transfer coefficient and high gas temperature region at approximately two-thirds of the blade chord location. FIG. 1 shows a cutaway view of the vortices formation of the hot flow gas migration across the turbine flow passage.

Cooling of the blade fillet region and platform by means of conventional backside convective cooling yields inefficient results due to the thickness of the airfoil fillet region and not being able to utilize effective cooling technique for the blade platform. As a result, a thermal mismatch between the blade airfoil and the platform creates LCF deficiency for the blade, and especially for a blade with a high mass platform.

BRIEF SUMMARY OF THE INVENTION

A rotor blade assembly in which adjacent rotor blades without platforms are secured within the rotor disk. A separate platform de-coupled from the rotor blades is secured to a dovetail projecting from the rotor disk and located between the rotor disk slots such that the platform loads are not transferred to the rotor blades or the disk slots. The platform is formed from a ceramic or other high temperature resistant material and occupies the entire space between the adjacent rotor blades and the outer disk surface such that no space is left for the immigration of the hot gas flow through the turbine. Purge cooling air is thus not required with the use of the un-coupled platform of the present invention. Use of the separate platform piece allows for the rotor blades to be formed from a single crystal material which allows for higher gas flow temperatures in the engine.

DETAILED DESCRIPTION OF THE INVENTION

Figure 1:
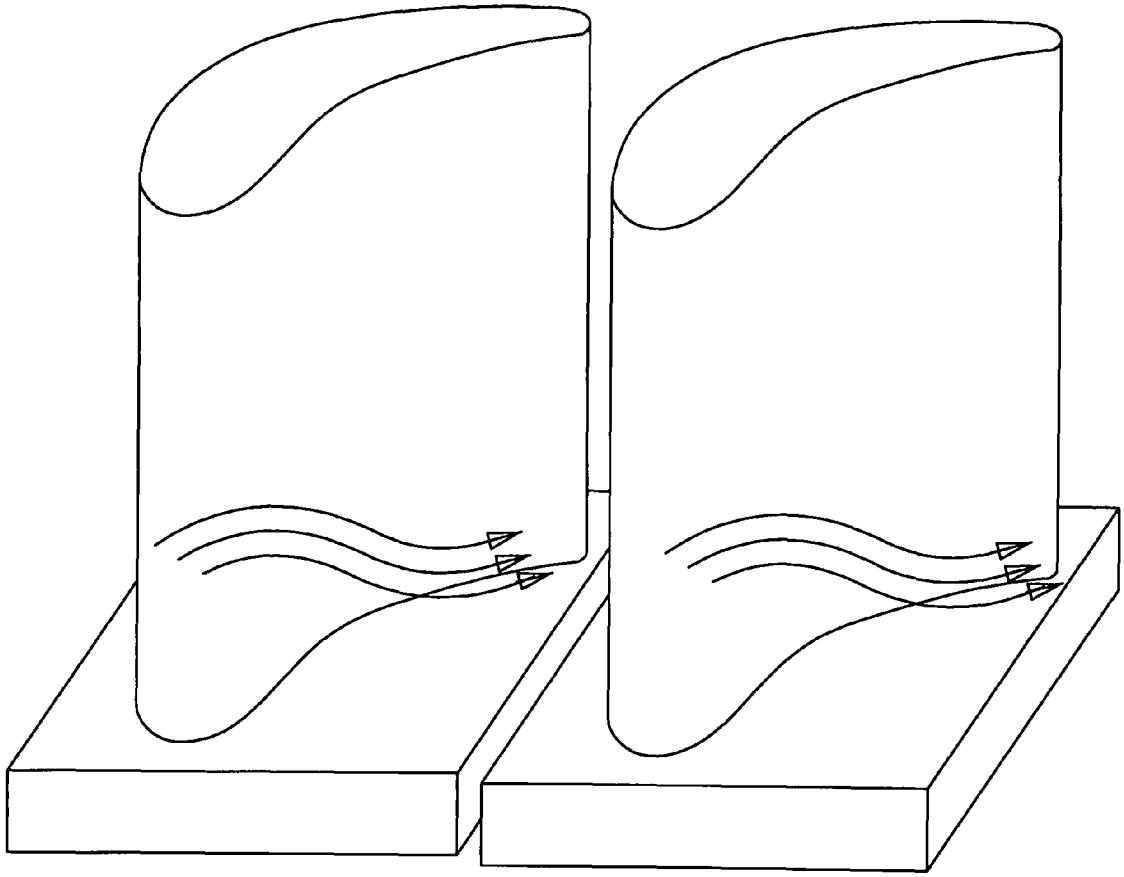
FIG. 1 shows a schematic of a turbine rotor blade assembly with the hot gas migration path across the turbine flow passage.
Figure 2:
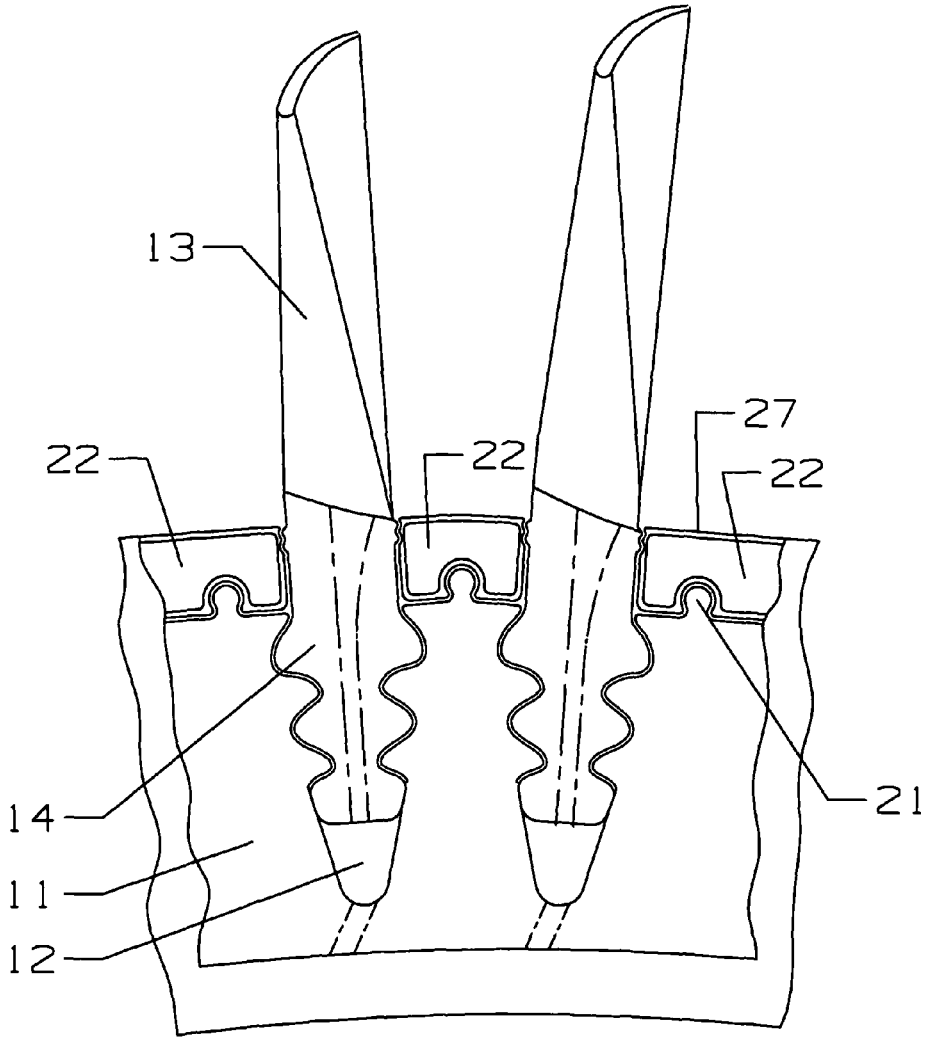
FIG. 2 shows a cross section view of the rotor disk assembly of the present invention with the separate platform piece.

The present invention is a separate high temperature resistant platform attached to a rotor disk in a gas turbine engine as seen in FIG. 2. The turbine of the engine includes multiple stages each with a row of rotor blades secured to the rotor disk view a root retention slot formed in the rotor disk. The rotor disk 11 in FIG. 2 includes a fir tree shaped slot 12 with a rotor blade 13 having a root portion 14 with a fir tree shaped configuration that slides within the disk slot 12 to secure the rotor blade to the rotor disk as is well known in the prior art. The rotor blades 13 and the rotor disk include cooling air passages to deliver pressurized cooling air from the engine source to the internal cooling passages within the blades.

Figure 4:
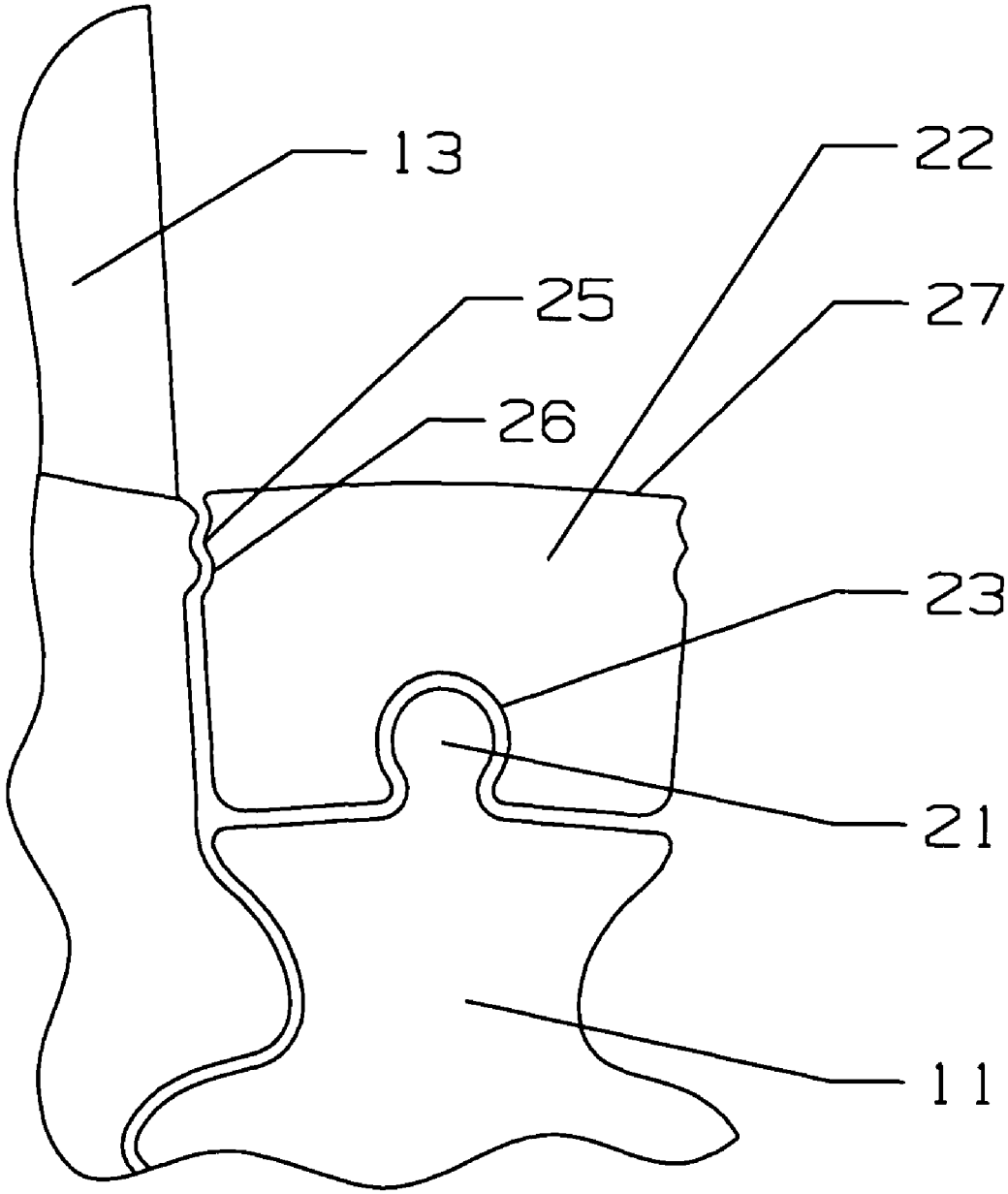
FIG. 4 shows a detailed view of the platform and blade engagement surface from FIG. 2 of the present invention.

In the present invention, the rotor blades 13 are formed without the platforms. Blade platforms form an inner flow path surface for the hot gas flow that passes through the blades. Since the blades of the present invention do not have platforms, the blades can be made from a single crystal material with a unidirectional grain structure. Single crystal turbine blades provide a number of advantages that are well known in the prior art such as higher resistance to temperature. The rotor disk 11 includes a dovetail 21 projecting from the outer disk surface and between the disk slots 12 as seen in FIG. 2. A composite platform (or, spacer or platform spacer) 22 includes a slot 23 on the underside that slides into the dovetail 21 of the rotor disk 11 to secure the platform 22 in place between adjacent rotor blades and to the rotor disk 11. The platform spacer 22 includes a top surface 27 that forms the flow path for the hot gas flow through the rotor blade assembly. The platform 22 includes projections 25 that form a groove 26 between adjacent projections 25 on the sides of the platform 22 and function to engage similar shaped projections and grooves on the blade root or transition piece as seen in FIG. 2 and in more detail in FIG. 4. These projections 25 and grooves 26 form a seal between the blade and the platform 22 to prevent the ingestion of the hot gas flow and also function to dampen vibrations.

Figure 3:
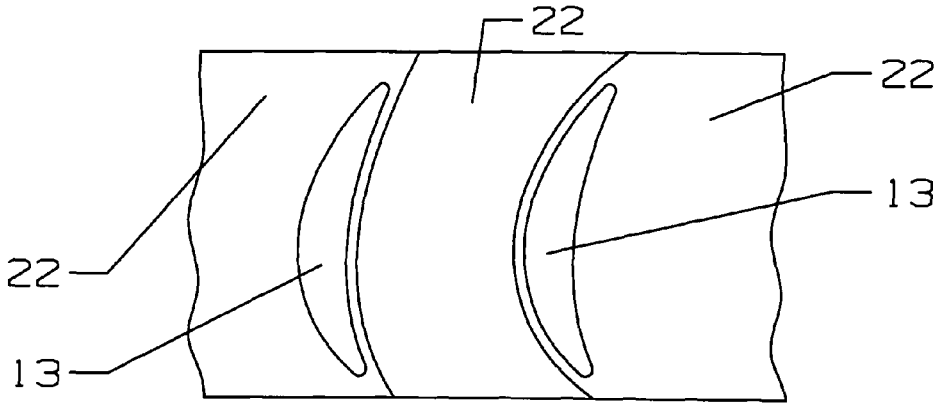
FIG. 3 shows a top view of the rotor blades and platform assembly of the present invention from FIG. 2.

A top view of the platform spacer 22 and adjacent rotor blades 22 is shown in FIG. 3. The leading edge and the trailing edge of the platform spacer 22 are straight and parallel to the blade edges. The pressure side and suction side of the platform spacer 22 are curved to follow the shape of the blade airfoil so that the gap is minimized. As with the disk slot and blade root, the slot 23 in the platform spacer 22 and the dovetail 21 projecting from the rotor disk 11 rim are straight to allow for the platform spacer to slide over the dovetail 21 during assembly.

The platform spacer 22 of the present invention is made from a lightweight and high temperature resistant material such as carbon-carbon or a ceramic material. Also, the platform spacer 22 is shaped to occupy the entire space formed between the adjacent rotor blades 13 and the rotor disk outer rim surface. This is one major difference between the present invention and the separate and uncoupled platform of the Strassberger patent described above in the BACKGROUND section. The Strassberger invention allows for too much space in which the hot gas flow can migrate into the space below the platform outer surface and the rotor disk. Because of the hot gas flow migration, purge cooling air is required to reduce the thermal effects of the hot gas migration. The platform spacer of the present invention eliminates the need for a purge cooling air.

Other benefits of the platform spacer 22 of the present invention over the Strassberger patent are the elimination of the connection element (#32 in the Strassberger patent), the composite platform spacer provides damping and sealing which allows for the elimination of the damping rings (#16 in the Strassberger patent), no cooling air is required for the blade platform or spacer of the present invention, the platform spacer of the present invention is a box formation which is much more rigid than the Strassberger platform, the platform spacer of the present invention provides insulation for the disk rim, and the platform spacer minimizes rocking movement of the platform due to the many connection tolerances present in the Strassberger invention. The two dovetails found in the Strassberger invention that connect the connection element double the tolerances that exist in the single dovetail used in the present invention.

The rotor disk dovetail 21 and the platform spacer slot 23 can be other shapes and sizes that would allow for the platform spacer to be placed onto the rotor disk and between adjacent rotor blades and still function to up-coupled the platform from the rotor blade and rotor disk retention slot. For example, a fir tree shaped extension and slot arrangement could be used. Even a retaining pin can be used to fit within concentric holes formed in the two parts can be used to secure the platform spacer to the rotor disk.

The platform spacer 22 is disclosed as being a solid piece for purposes of providing damping to the rotor blade assembly, to eliminate gaps that require purge air, and to form a more rigid structure between the adjacent blades. However, the platform spacer could be slightly hollowed out from the bottom such that the top and side surfaces still provide the capability of occupying the space formed between the two adjacent blades while still performing the above described just described functions. However, forming the platform spacer from a solid piece would be easier to manufacture.

I claim the following:

1. A rotor blade assembly for use in a gas turbine engine, the rotor blade assembly comprising:

a rotor disk comprising at least two adjacent rotor blade retention slots;

a dovetail projecting from the rotor disk rim between the two adjacent rotor blade retention slots at a location about midway on the rotor disk rim;

the dovetail being separate from the retention slots;

a rotor blade having a root portion and an airfoil portion secured to each of the two adjacent rotor blade retention slots; and, a platform spacer secured to the dovetail of the rotor disk, the platform spacer occupying substantially all of the space formed between the two adjacent rotor blades and the rotor disk and forming a flow path surface for the hot gas flow through the rotor blade assembly.

2. The rotor blade assembly of claim 1, and further comprising:

the platform spacer is substantially a solid piece.

3. The rotor blade assembly of claim 2, and further comprising:

the platform spacer is sized and shaped to fit within the space between the adjacent rotor blades and the rotor disk rim to provide damping to the rotor blade assembly.

4. The rotor blade assembly of claim 1, and further comprising:

the platform spacer includes blade engagements surfaces on the pressure side and the suction side of the spacer platform to form a hot gas flow seal between the platform spacer and the adjacent rotor blades.

5. The rotor blade assembly of claim 1, and further comprising:

the rotor blades are formed from a single crystal material; and, the platform spacer is formed from a lightweight and high temperature resistant material.

6. The rotor blade assembly of claim 1, and further comprising:

the platform spacer includes leading edge and trailing edge sides that are substantially flush with the rotor disk sides, and the platform spacer includes pressure side and suction side ends that follow the curvature of the blade such that a gap formed between the rotor blade and the platform spacer is minimized.

7. A platform spacer for use in a rotor blade assembly to form a platform between adjacent rotor blades in the assembly, the platform spacer comprising:

a dovetail slot formed on the bottom surface of the platform spacer to secure the platform spacer to the rotor disk;

a top surface forming a hot gas flow path through the adjacent rotor blades;

a pressure side surface having a contour of the pressure side surface of the rotor blade on the one side; and, a suction side surface having a contour of the suction side surface of the rotor blade on the other side.

8. The platform spacer of claim 7, and further comprising:

the platform spacer is a solid piece.

9. The platform spacer of claim 7, and further comprising:

the platform spacer includes a seal forming member on the pressure side and the suction side of the platform spacer to engage with the adjacent rotor blade to form a seal between the gaps.

10. The platform spacer of claim 7, and further comprising:

the platform spacer is sized to occupy substantially the entire space formed between the adjacent rotor blades and the rotor disk rim.

11. The platform spacer of claim 7, and further comprising:

the platform spacer is formed from a lightweight and high temperature resistant material.

* * * * *